US007228084B2

(12) United States Patent
Umezawa et al.

(10) Patent No.: US 7,228,084 B2
(45) Date of Patent: Jun. 5, 2007

(54) IMAGE FORMING APPARATUS AND FIXING DEVICE

(75) Inventors: Noriyuki Umezawa, Yokohama (JP); Taizo Kimoto, Tokyo (JP); Kenji Takano, Tokyo (JP); Hisaaki Kawano, Chigasaki (JP); Hiroshi Nakayama, Kawasaki (JP); Osamu Takagi, Tokyo (JP); Satoshi Kinouchi, Tokyo (JP); Kazuhiko Kikuchi, Yokohama (JP); Masahiko Ogura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/210,726

(22) Filed: Aug. 25, 2005

(65) Prior Publication Data

US 2005/0281576 A1 Dec. 22, 2005

Related U.S. Application Data

(63) Continuation of application No. 10/840,329, filed on May 7, 2004, which is a continuation of application No. 10/614,059, filed on Jul. 8, 2003, now Pat. No. 6,748,184, which is a continuation of application No. 10/316,046, filed on Dec. 11, 2002, now Pat. No. 6,625,405, which is a continuation of application No. 09/939,731, filed on Aug. 28, 2001, now Pat. No. 6,496,665, which is a continuation of application No. PCT/JP99/07410, filed on Dec. 28, 1999.

(51) Int. Cl.
*G03G 15/20* (2006.01)
*H05B 6/14* (2006.01)

(52) U.S. Cl. ..... 399/67; 399/70; 219/619

(58) Field of Classification Search ..... 219/216, 219/619; 399/33, 67, 69, 70, 328, 330
See application file for complete search history.

(56) References Cited

U.S. PATENT DOCUMENTS 5,794,096 A * 8/1998 Okabayashi ..... 399/33

(Continued)

FOREIGN PATENT DOCUMENTS

JP 56-144469 11/1981

(Continued)

OTHER PUBLICATIONS

Office Action in U.S. Appl. No. 10/840,329, dated Feb. 22, 2006.

*Primary Examiner*—Hoang Ngo
(74) *Attorney, Agent, or Firm*—Foley & Lardner LLP

(57) ABSTRACT

The present invention provides a fixing device and a digital photocopier which can shorten the time from an instruction of starting image formation to end of fixing. The fixing device is provided in a cylinder made of metal and having a small thickness, and includes a magnetic excitation coil. When the power source is turned on, all the electric power defined by subtracting an electric power amount consumed by components other than the fixing device is supplied to the magnetic excitation coil to perform heating. As the structural components of the photocopier and auxiliary devices added to the photocopier operate, the electric power defined by subtracting, from the maximum input electric power, the electric power consumed by the structural components of the photocopier and the auxiliary devices is supplied to perform heating. In this manner, the heat roller of the fixing device is heated, in a short time, to a temperature which enables fixing, so that the time required for first copying can be shortened.

11 Claims, 6 Drawing Sheets

U.S. PATENT DOCUMENTS

| | | | | |
|---|---|---|---|---|
| 5,899,599 | A | 5/1999 | Kato | |
| 6,006,051 | A | 12/1999 | Tomita et al. | |
| 6,278,852 | B1 | 8/2001 | Hayashi | |
| 6,496,665 | B2 * | 12/2002 | Umezawa et al. | 399/67 |
| 6,625,405 | B2 | 9/2003 | Umezawa et al. | |

FOREIGN PATENT DOCUMENTS

| | | | |
|---|---|---|---|
| JP | 57-46258 | | 3/1982 |
| JP | 58-105180 | | 6/1983 |
| JP | 58-114049 | A | 7/1983 |
| JP | 59-33476 | | 2/1984 |
| JP | 63-168989 | | 7/1988 |
| JP | 01-310380 | A | 12/1989 |
| JP | 04-006581 | A | 1/1992 |
| JP | 4-372977 | | 12/1992 |
| JP | 07-319312 | A | 12/1995 |
| JP | 08-063022 | A | 3/1996 |
| JP | 09-096990 | A | 4/1997 |
| JP | 09-152805 | A | 6/1997 |
| JP | 9-258586 | | 10/1997 |
| JP | 10-186935 | | 7/1998 |
| JP | 10-254306 | | 9/1998 |
| JP | 10-301442 | | 11/1998 |
| JP | 10-301442 | A | 11/1998 |
| JP | 10-302954 | | 11/1998 |
| JP | 10-333489 | | 12/1998 |
| JP | 11-126678 | | 5/1999 |
| JP | 11-143269 | | 5/1999 |

* cited by examiner

| POWER (W) | OPERATION MODE | | | | | |
|---|---|---|---|---|---|---|
| | POWER ON | INITIALIZE | +PRE-RUN | COPY OPERATION | +ADF | STAND-BY |
| 1,300 | ○ | | | | | |
| 1,200 | | ○ | | | | |
| 1,000 | | | ○ | | | |
| 900 | | | | ○ | | |
| 800 | | | | ○ | ○ | |
| 750 | | | | | | ○ |
| 700 | | | | | | ○ |

IMAGE FORMING APPARATUS AND FIXING DEVICE

CROSS-REFERENCE TO RELATED APPLICATIONS

This is a continuation of Ser. No. 10/840,329, filed May 7, 2004, which is a continuation of Ser. No. 10/614,059, filed Jul. 8, 2003 (now U.S. Pat. No. 6,748,184) (the entire contents of which are incorporated hereby by reference) which is a continuation of Ser. No. 10/316,046, filed Dec. 11, 2002 (now U.S. Pat. No. 6,625,405), which is a continuation of Ser. No. 09/939,731, filed Aug. 28, 2001, (now U.S. Pat. No. 6,496,665) which is a continuation application of PCT Application No. PCT/JP99/07410, filed Dec. 28, 1999, which was not published under PCT Article 21(2) in English.

BACKGROUND OF THE INVENTION

1. Field of the Invention

The present invention relates to an image forming apparatus such as an electrostatic photocopier, a laser printer, or the like in which a toner image is fixed to a fixing material.

2. Description of the Related Art

In a fixing device incorporated in a photocopier using an electrophotographic process, a developer which is toner formed on a fixing material is heated and melted to fix the toner to the fixing material. A method of using radiated heat based on a halogen lamp (a filament lamp) is widely used as a method for heating toner usable for a fixing device.

With respect to the method of using a halogen lamp as a heat source, a structure is widely used, i.e., paired rollers are provided such that a predetermined pressure can be applied to the fixing material and toner, at least one of the paired rollers is used as a hollow column, and a halogen lamp arranged in a column is arranged in the inner hollow space. In this structure, the roller provided with a halogen lamp forms an acting part (nip) at a position where the roller contacts with the other roller, so that pressure and heat are applied to a fixing material and toner guided to the nip. That is, the fixing material, i.e., a paper sheet is passed through a fixing point which is a press contact part between a heat roller provided with a lamp and a press roller which rotates as a slave to the heat roller, and thus, toner on the paper sheet is melted and fixed to the paper sheet.

In the fixing device using a halogen lamp, light and heat from the halogen lamp is radiated in all directions to the entire circumference of the heat roller. In this case, it is known that the thermal conversion efficiency is 60 to 70%, the thermal efficiency is low, the power consumption is large, and the warm-up time is long, in consideration of the loss at the time when light is converted into heat, the efficiency at which air in the roller is warmed to transfer heat to the holler, and the like.

Hence, as a heat source for a heat roller, an induction heating method has been practiced, in which a heat coil is provided inside a heat roller, and a high-frequency current is supplied to the coil, so that heating is carried out by induction heating.

For example, Japanese Patent Application KOKAI Publication No. 59-33476 discloses a technique in which a roller having a thin metal layer on the outer circumference of ceramics cylinder is comprised and an induction current is passed through the thin metal layer of the roller with use of a conductive coil to achieve heating.

Japanese Patent Application KOKAI Publication No. 258586 discloses a method which uses a heat generation member in which a coil is wound around a core provided along the rotation axis of a fixing roller, and which achieves heating by flowing eddy current through the fixing roller.

Since the induction heating heats a roller by eddy current obtained as a result of flowing current through a coil, a large electric power is required to heat a heat roller to a predetermined temperature in a short time period.

However, a fixing device used in a photocopier has an upper limit to the power which can be consumed singly by only the fixing device, and electric power is also consumed by a large number of components constructing the photocopier. It is therefore known that a large electric power cannot be continuously supplied only to the fixing device.

Therefore, if a large electric power cannot be distributed to heating of the heat roller of the fixing device, the warm-up time of the photocopier is elongated, so that the time required for obtaining a copy is also elongated. If priority is given to warm-up of the photocopier, the fixing rate is insufficient in some cases. Meanwhile, in a heat roller having a structure in which the heat roller is formed into a thin cylinder made of metal and a coil is provided inside the cylinder along the axial direction of the cylinder, an irregular temperature distribution is caused on the outer circumferential surface of the roller. Therefore, the heat roller must be rotated in contact with the press roller when the temperature of the heat roller increases, to make uniform the temperature of the outer circumferential surface of the heat roller. This lengthens not only the warm-up time but also the electric power required for heating.

BRIEF SUMMARY OF THE INVENTION

The present invention has an object of providing an image forming apparatus capable of shortening the time from when the power source is turned on to when copying can be accepted, i.e., a so-called first copy time, and also capable of supplying an effective maximum electric power for a fixing device without exceeding the upper limit of power consumption.

The present invention has been made on the basis of the problems described above and provides a fixing device for use in an image forming apparatus in which a high-frequency current is supplied to through a coil provided close to an endless member having a metal layer made of a conductive material and this endless member is caused to generate heat to heat a material to be fixed, wherein the fixing device is controlled in accordance with a plurality of electric power control patterns corresponding to electric power supply amounts for predetermined conditions, respectively.

Also, the present invention provides an image forming apparatus comprising:

a photosensitive member for holding an electrostatic latent image;

an exposure device for forming an electrostatic latent image on the photosensitive member;

a developing device for supplying the electrostatic latent image formed on the photosensitive member, with a developer, to form a developer image; and a fixing device for heating a transfer member to which the developer image formed by the developing device is transferred, thereby to fix the developer image to the transfer member, wherein the fixing device flows a high-frequency current through a coil provided close to an endless member having a metal layer made of a conductive material, thereby heating the endless member, to heat the transfer member and the developer image, and the fixing device is controlled by a plurality of electric power control patterns corresponding to electric power amounts which can be supplied for predetermined conditions, respectively.

Further, the present invention provides the apparatus according to claim 10, wherein the electric power control patterns are used to detect a change of a power source voltage capable of supplying a high-frequency current to be supplied, to supply a high-frequency current having an optimal frequency or duty ratio.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

In the following, a fixing device as an embodiment according to the present invention will be explained with reference to the drawings.

Figure 1:
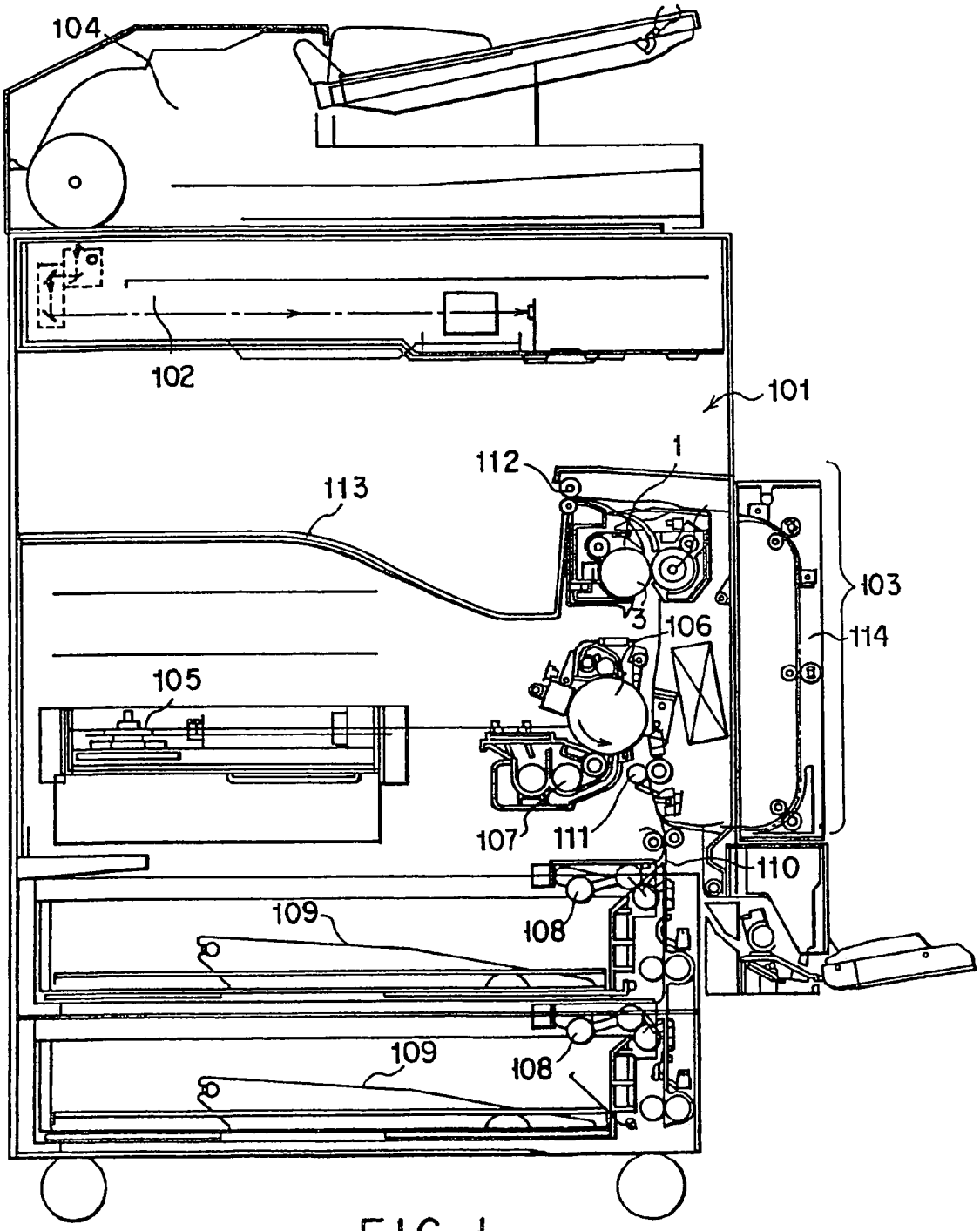
FIG. 1 is a schematic view which explains a digital photocopier which incorporates a fixing device as an embodiment according to the present invention.

FIG. 1 is a schematic view which explains a digital photocopier 101 as an example of an image forming apparatus. As shown in FIG. 1, the digital photocopier 101 comprises a scanner 102 which reads image information of a copy target as brightness/darkness of light and generates an image signal, and an image forming section 103 which forms an image corresponding to the image signal supplied from the scanner 102 or the outside. Note that the scanner 102 is integrally provided with an automatic document feeder (ADF) 104 which operates in association with the operation of reading an image by the scanner 102 and replaces copy targets sequentially, when the copy targets are sheet-like materials.

The image forming section 103 includes an exposure device 105 for irradiating a laser beam corresponding to image information supplied from the scanner 102 or an external device, a photosensitive drum 106 for holding an image corresponding to the laser beam from the exposure device 105, a developing device 107 for supplying a developer to an image formed on the photosensitive drum 106 to develop the image, and a fixing device 1 for heating and melting a developer image transferred from the photosensitive drum 106, on which the developer image has been developed by the developing device 107, to a transfer material supplied from a sheet conveyer section explained later.

When image information is supplied from the scanner 102 or an external device, a laser beam subjected to intensity-modulation based on the image information is irradiated to the photosensitive drum 106 which has previously been charged to a predetermined electric potential.

In this manner, an electrostatic latent image corresponding to an image to be copied is formed on the photosensitive drum 106.

The electrostatic latent image formed on the photosensitive drum 106 is selectively supplied with toner T and developed by the developing device 107, and is then transferred to a paper sheet P as a transfer material supplied from a cassette explained later, by a transfer device.

The toner T transferred to the paper sheet T is conveyed to the fixing device 1 where the toner T is melted and fixed.

Paper sheets P are picked up one after another from a sheet cassette 109 provided below the photosensitive drum 106 by a pickup roller 108, pass through a conveyor path 110 oriented to the photosensitive drum 106, and are conveyed to an aligning roller 111 for aligning each paper sheet with the toner image (developer image) formed on the photosensitive drum 106. Each paper sheet is supplied, at a predetermined timing, to a transfer position where the photosensitive drum 106 and the transfer device face each other.

Meanwhile, a paper sheet P to which an image has been fixed by the fixing device 1 is fed out into an ejection space (sheet ejection tray) defined between the scanner 102 and the cassette 109. A double-sided sheet feeder 114 which reverses the front and back surfaces of the paper sheet P with the image fixed to one surface is provided between the fixing device 1 and the cassette 109, if necessary.

Next, the fixing device 1 will be explained specifically.

Figure 2:
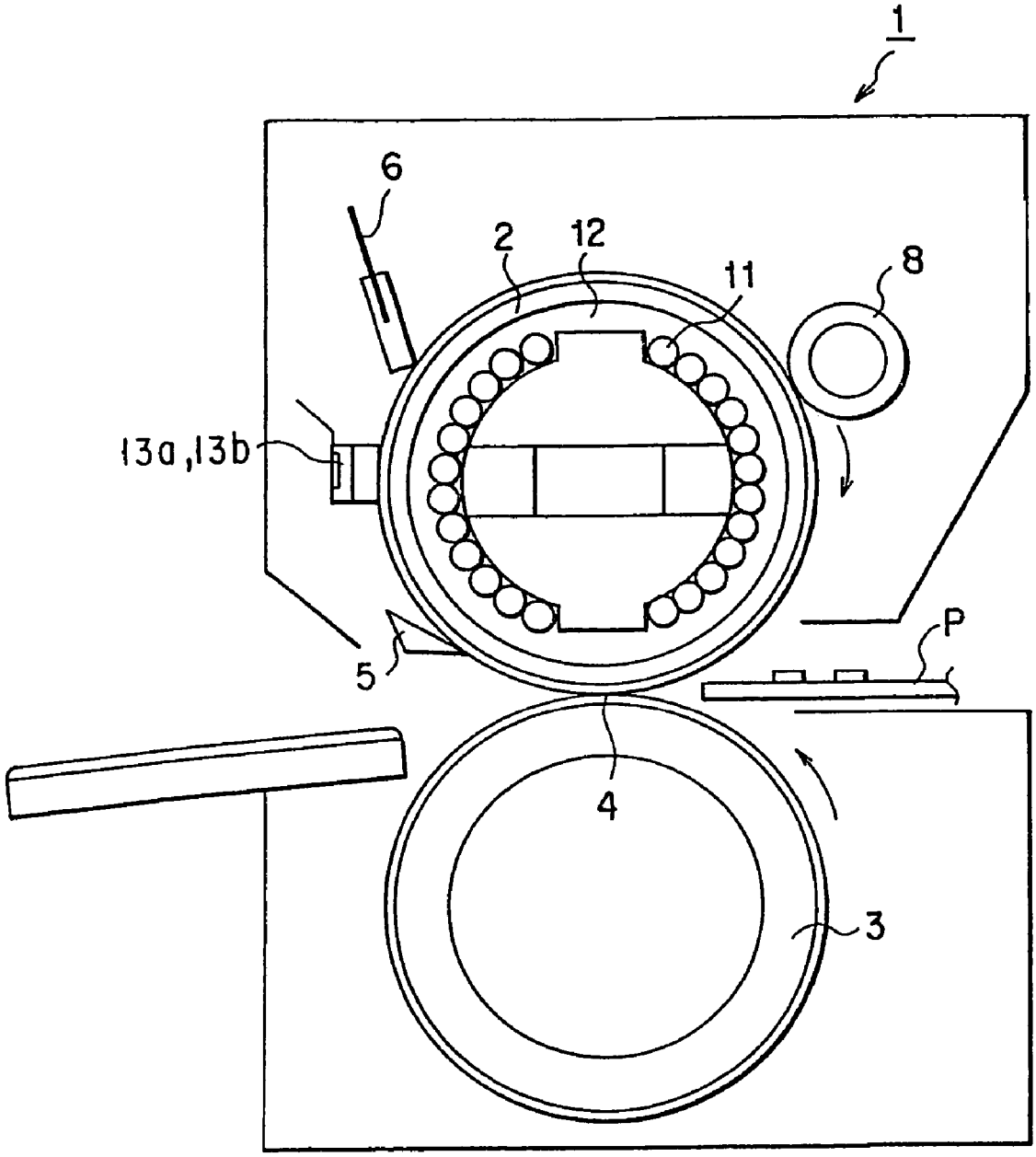
FIG. 2 is a schematic view showing the entire structure of the fixing device of the photocopier shown in FIG. 1.
Figure 3:
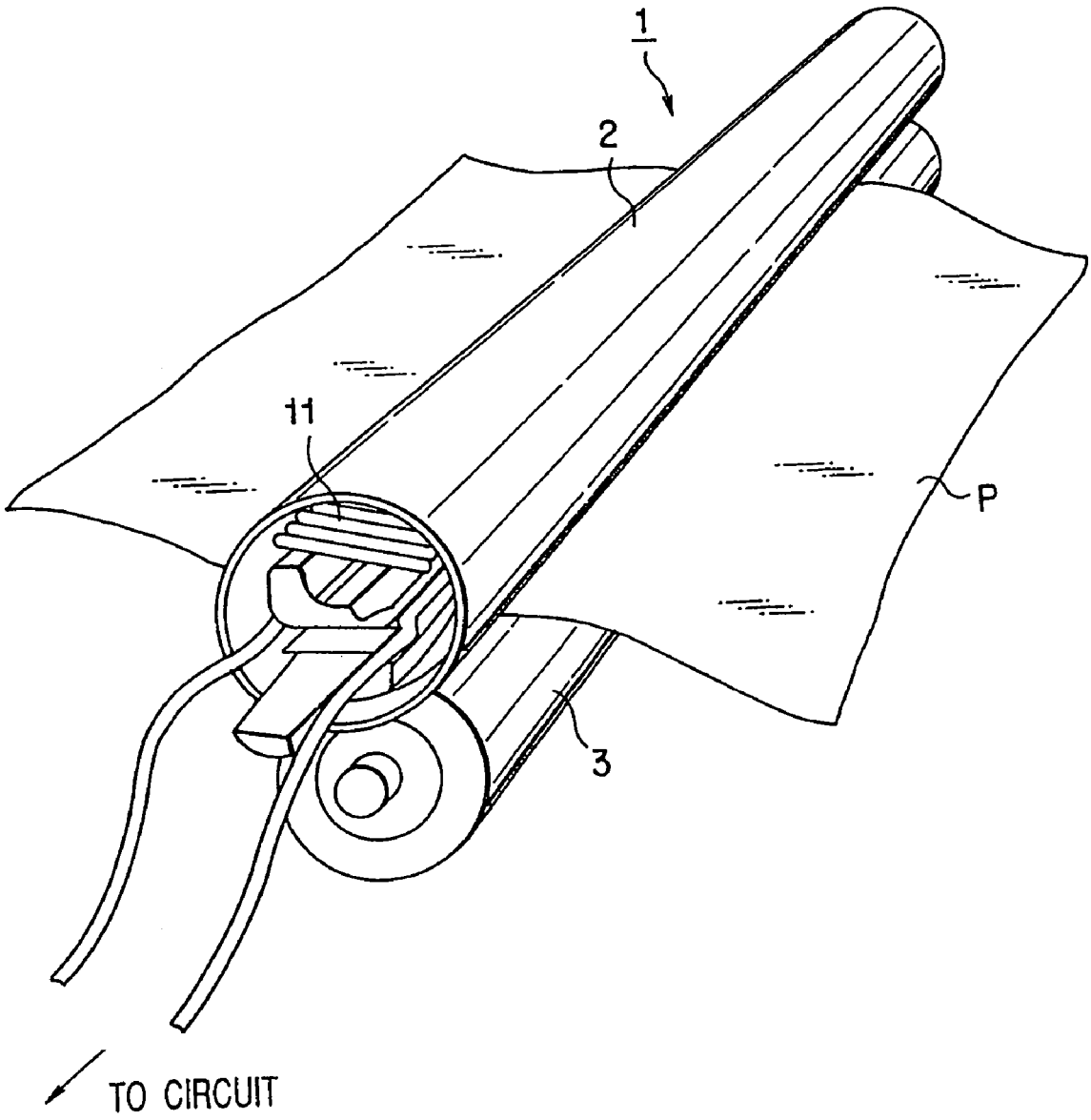
FIG. 3 is a perspective view schematically showing the structure of a heat roller and a coil as a magnetic field generation means in the fixing device shown in FIG. 2.

FIG. 2 is a schematic cross-sectional view which explains an embodiment of the fixing device incorporated in the digital photocopier shown in FIG. 1. FIG. 3 is a schematic perspective view showing the shape of a coil incorporated in the fixing device shown in FIG. 2.

As shown in FIGS. 2 and 3, the fixing device 1 is constructed of a heat (fixing) roller 2 and a press roller 3. Each of the rollers has an outer diameter of 40 mm, for example.

The heat roller 2 is driven in the arrow direction by a drive motor not shown. Note that the press roller 3 rotates in the arrow direction in association with the heat roller. A paper sheet P as a fixing material supporting a toner image T is passed between both rollers.

The heat roller 2 is, for example, an endless member having a metal layer, which is constructed by an iron cylinder having a thickness of 1 mm, i.e., conductive material. A mould-releasing layer of Teflon or the like is formed on the surface of the member. In addition, stainless steel, aluminum, an alloy of stainless steel or aluminum, or the like can be used for the heat roller 2.

The heat roller 3 is constructed by coating elastic material such as silicon rubber, fluoro rubber, or the like on the circumference of a core metal. The heat roller 3 is pressed against a heat roller 2 at a predetermined pressure by a press mechanism not shown, thereby to provide a nip (where the outer circumferential surface of the press roller 3 is elastically deformed by a press contact) having a predetermined width at a position where both rollers contact each other.

In this manner, as a paper sheet 4 passes through the nip 4, toner on the paper sheet is melted and fixed to the paper sheet P.

In the downstream side of the nip 4 on the circumference of the heat roller 2 in the rotating direction, a peeling nail 5 for peeling the paper sheet P off from the heat roller 3, a cleaning member 6 for removing paper particles and toner transferred to the outer circumferential surface of the heat roller 2 by an off-set manner, a mould-releasing agent application device 8 for applying a mould-releasing agent to prevent toner from sticking to the outer circumferential surface of the heat roller 2, and thermistors 13*a*, 13*b* for detecting the temperature of the outer circumferential surface of the heat roller 2.

A magnetic excitation coil 11 as a magnetic field generation means made of a litz wire is provided inside the heat roller 2, and the litz wire is constructed by a plurality of bundled copper wire members insulated from each other and each having a diameter of, for example, 0.5 mm. By constructing the magnetic excitation coil by a litz wire, the wire diameter can be reduced to be smaller than the penetration depth, so that a high-frequency current can effectively flow. The magnetic excitation coil 11 used in the embodiment shown in FIG. 2 is constructed by 19 heat-resistant wire members each having a diameter of 0.5 mm and coated with polyamide-imide.

The magnetic excitation coil 11 is also an air-core coil which does not use any core member (such as a ferrite core, an iron core, or the like). Since the magnetic excitation coil 11 is thus formed as an air-core coil, a core member having a complicated shape is not required, so that costs are reduced. Also, the price of the magnetic excitation circuit can be reduced.

The magnetic excitation coil 11 is supported by a coil support member 12 formed of heat-resistant resins (e.g., industrial plastic having a high heat resistance).

The coil support member 12 is positioned by a structure (plate metal) not shown but holding the heat roller.

The magnetic excitation coil 11 causes the heat roller 2 to generate magnetic flux and eddy current, so that changes of the magnetic field are prevented by the magnetic flux generated by a high-frequency current from a magnetic excitation circuit (inverter circuit) explained in later paragraphs with reference to FIG. 4. Joule heat is generated by the eddy current and the resistance specific to the heat roller 2, so the heat roller 2 is heated. In this example, a high-frequency current of 25 kHz and 900 W flows through the magnetic excitation coil 11.

Figure 4:
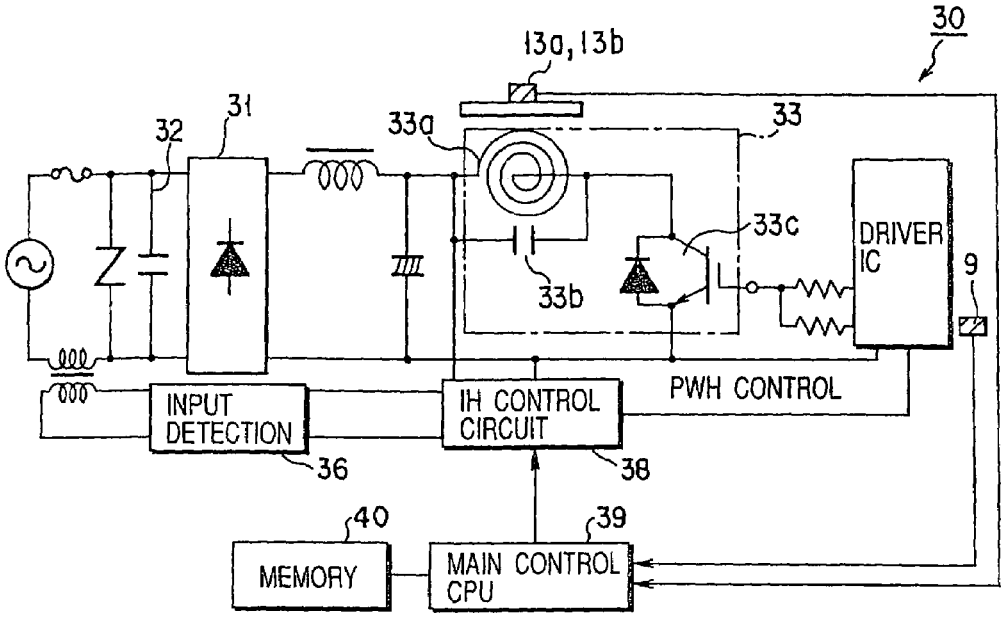
FIG. 4 is a schematic view which explains a circuit diagram (a semi-E-class inverter circuit) for driving an induction heating (magnetic excitation) coil of the fixing device shown in FIG. 2.
Figure 5:
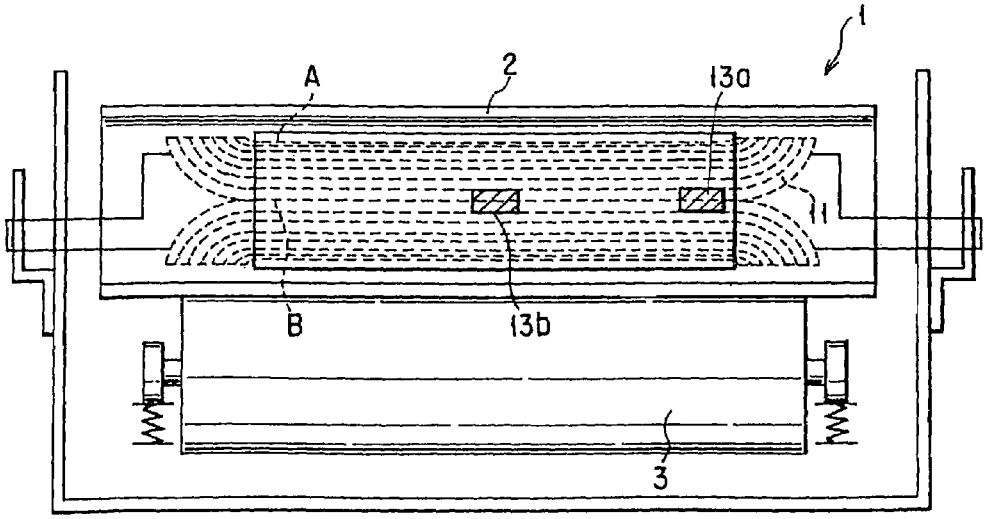
FIG. 5 is a schematic view which explains the structure of the coil in the lengthwise direction of the fixing device shown in FIG. 2.

FIG. 4 is a block diagram showing the control system, i.e., a drive circuit of the fixing device shown in FIGS. 2 and 3.

In the drive circuit 30, the high-frequency current is obtained by rectifying an alternating current from a commercial power source by means of a rectifier circuit 31 and a smoothing capacitor 32, and is supplied to the magnetic excitation coil 11 through a coil 33*a*, a resonant capacitor 33*b*, and a switching circuit 33*c*.

The high-frequency current is detected by an input detection means 36 and is controlled to maintain a specified output value. Note that the specified output value can be controlled by changing the ON time of the switching element 33*c* at an arbitrary timing, for example, under PWM (Pulse Width Modulation) control. At this time, the drive frequency is changed optimally. Changes of an input voltage are also detected by the input detection means 36.

Information from a temperature detection means (two thermistors 13*a* and 13*b* explained later and provided at two positions on the surface of the heat roller 2) for detecting the temperature of the heat roller 2 is inputted to the main control CPU 39 and is further inputted to an IH (induction heating) circuit 38 in accordance with an ON/OFF signal from the CPU 39. An output from thermistors 13*a*, 13*b* is inputted also to the IH circuit 38 and serves to control an abnormal temperature of a driver IC. The main control CPU 39 controls the scanner 102, the ADF 104, the exposure device 105, the developing device 107, a large number of components forming part of a motor (not shown) for rotating the photosensitive drum 106 and the image forming section 103, the pickup roller 108, the aligning roller 111, the ejection roller 112, and the like. The operation status of these components, conveying status (jamming of paper) of paper sheets P conveyed through the conveyor path 110, and the like are reported sequentially through an interface not shown, to control them.

In FIG. 2, the surface temperature of the heat roller 2 is controlled to 180° C. by temperature detection based on the thermistors 13*a*, 13*b* and by feedback control based on a detection result.

A condition necessary for fixing toner to a paper sheet P is to make uniform the temperature of the entire area in directions toward the circumference of the heat roller 2. While the heating roller 2 stops rotating, generation of magnetic flux acts in different intensities in directions toward the circumference due to the characteristic of the magnetic excitation coil 11 as an air-core coil shown in FIG. 2. The temperature distribution is therefore not uniform. Consequently, unevenness of the temperature in the direction to the circumference of the roller 2 must be eliminated immediately before a paper sheet P passes through the nip 4.

Therefore, the heat roller 2 and the press roller 3 are rotated to make uniform the temperature distribution of the entire roller, after a predetermined time, although rotation of the heat roller 2 is stopped for a constant time period in order to efficiently increase the temperature of the heat roller 2 immediately after the magnetic excitation coil 11 is energized.

By rotating the heat roller 2 and the press roller 3, a constant amount of heat is applied to the entire surface of both of the rollers. In addition, the surface temperature decreases to be temporarily lower than the target surface temperature of 180° C., as will be explained later with reference to FIG. 7, because both of the rollers 2 and 3 rotate.

When the surface temperature of the heat roller 2 reaches 180° C., a copy operation is enabled, and a toner image is formed on a paper sheet P at predetermined intervals.

As the paper sheet P passes through a roll-contact part, i.e., the nip 4 between the heat roller 2 and the press roller 3, the toner on the paper sheet P is fixed to the same paper sheet P.

The thermistors 13*a* and 13*b* are useful for removing the effects of differences in the temperature of the outer surface of the heat roller 2 caused by magnetic excitation coil 11 when the heat roller 2 and the press roller 3 are stopped. The thermistors 13*a*, 13*b* serves to detect the temperature of the driver IC itself and forcedly shuts off electric conduction to the coil when abnormal heat generation occurs in the driver IC.

Figures 6, 7:
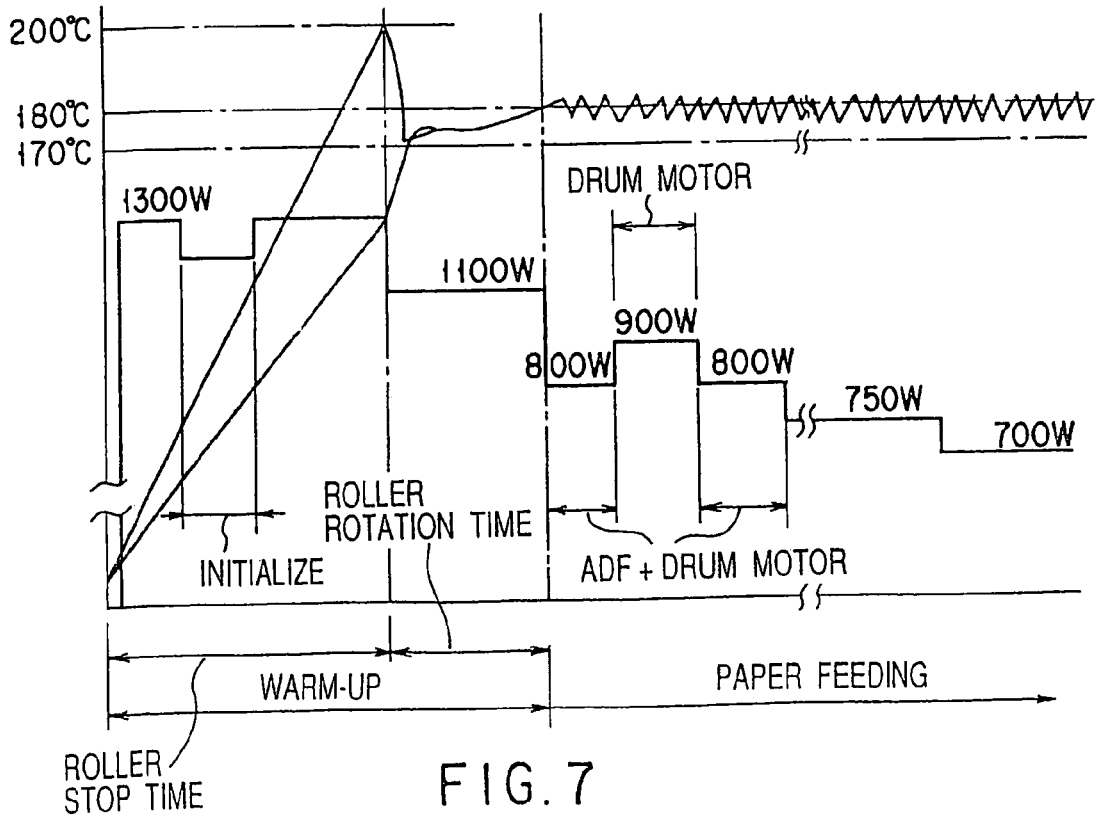
FIG. 6 is a schematic view (of information in a table in a memory) showing the relationship between the operation mode and the amount of electric conductance (the amount of electric power) to the magnetic excitation coil of the heat roller where the fixing device shown in FIG. 2 is incorporated in the photocopier shown in FIG. 1.
FIG. 7 is a schematic view which explains the relationship between a temperature increase of the heat roller and the electric power which can be supplied for the coil, in the operation of the fixing device shown in FIG. 6.

FIG. 6 is a timing chart explaining an example in which the output value of the high-frequency current to the magnetic excitation coil 11 is changed after or in the middle of warm-up of the heat roller 2, in the fixing device previously explained with reference to FIGS. 2 to 5.

As shown in FIG. 6, for example, in the case of a commercial power source of 1500 W controlled by the main control CPU 39, all the remaining electric power other after subtracting the electric power consumed by other components of the digital photocopier 101 other than the fixing device 1, can be supplied to the magnetic excitation coil 11 in the initial period during warm-up. In the present embodiment, 1300 W is the upper limit. As shown in FIG. 7, however, the upper limit is set to 1200 W while the initializing operation of each part of the photocopier 101 is being executed while heating the heat roller 2.

Thereafter, the heat roller 2 and the press roller 3 are rotated from a time point in the middle of the start up period (e.g., after the temperature of the heat roller 2 exceeds 200° C.). The upper power limit is set to 1100 W, as a value obtained by subtracting the electric power consumed by rotation of a motor (not shown) for rotating the photosensitive drum 106, and the electric power consumed by operation check and stand-by of the scanner 102, the ADF 104, the exposure device 105, the developing device 107, and the like.

If normal warm-up is completed and a stand-by state is continued, the electric power supplied to the magnetic excitation coil 11 is limited to 750 or 700 W.

Meanwhile, the photocopier 101 is connected with a cassette having a large capacity and the like in addition to the ADF 4. In addition, a paper sheet motor for rotating the pickup roller 108 of the paper sheet cassette 109 and a main motor for rotating he photosensitive drum 106 are rotated when forming an image. Hence, the electric power which can be supplied to the fixing device 1 changes in accordance with the operation states of the other structural components. It is therefore necessary to limit those structural components that can simultaneously operate so that the peak value of the power consumption does not exceed the maximum input power, in accordance with the operation states of the other structural components. The structural components which are working can be confirmed from the information inputted through input ports not shown of the CPU 39 and an interface also not shown.

For example, as shown in FIG. 7, the upper electric power limit is 900 W during a copying operation. If the ADF 4 is also operated, the upper limit must be restricted to 800 W.

The restrictions of the upper electric power limits shown in FIGS. 7 and 6 can be easily realized by arbitrarily setting the frequency of the high-frequency output from the IH circuit 38, based on a plurality of control patterns previously stored in the memory 40, in the drive circuit shown in FIG. 4. In addition, the temperature of the outer surface of the heat roller 2 is controlled to be constant. With respect to the electric power to be added, the duty ratio to the high-frequency output may be changed in addition to the frequency.

Meanwhile, at the time of completion of the image forming operation in the case where an image forming operation is repeated continuously, the factors which lower the temperature of the heat roller 2 may be reduced due to the heat transferred from the heat roller 2 to the press roller 3, in some cases. In this case, the maximum value of the current to be supplied to the magnetic excitation coil 11 is reduced. That is, there is a case that the temperature of the heat roller 2 can be maintained by an electric power of 700 W. In this case, copper loss caused by the wire material of the coil 11 is also reduced so that the heat conversion efficiency is improved.

The relationship between the operation mode and the electric power which can be supplied for the coil can be arbitrarily selected from a table stored in correspondence with various conditions, among a plurality of memory tables in compliance with the number of components connected to the photocopier 101 and the power consumptions (processing abilities) thereof.

Also, if the drive circuit explained with reference to FIG. 4 is capable of responding to a plurality of voltages and can be set arbitrarily in compliance with the voltage available at the installation location (e.g., a case where a photocopier 101 specific to 240 V can be operated at 220 V or where the drive circuit can be compatible with voltages of both 200 V and 100 V), an optimal relationship, shown in FIG. 6, between the operation mode and the electric power which can be supplied for the coil is selected and set in compliance with the actual supply voltage. In this case, it is possible to add control of changing the duty ratio to the high-frequency current to the control of the electric power.

Figure 8:
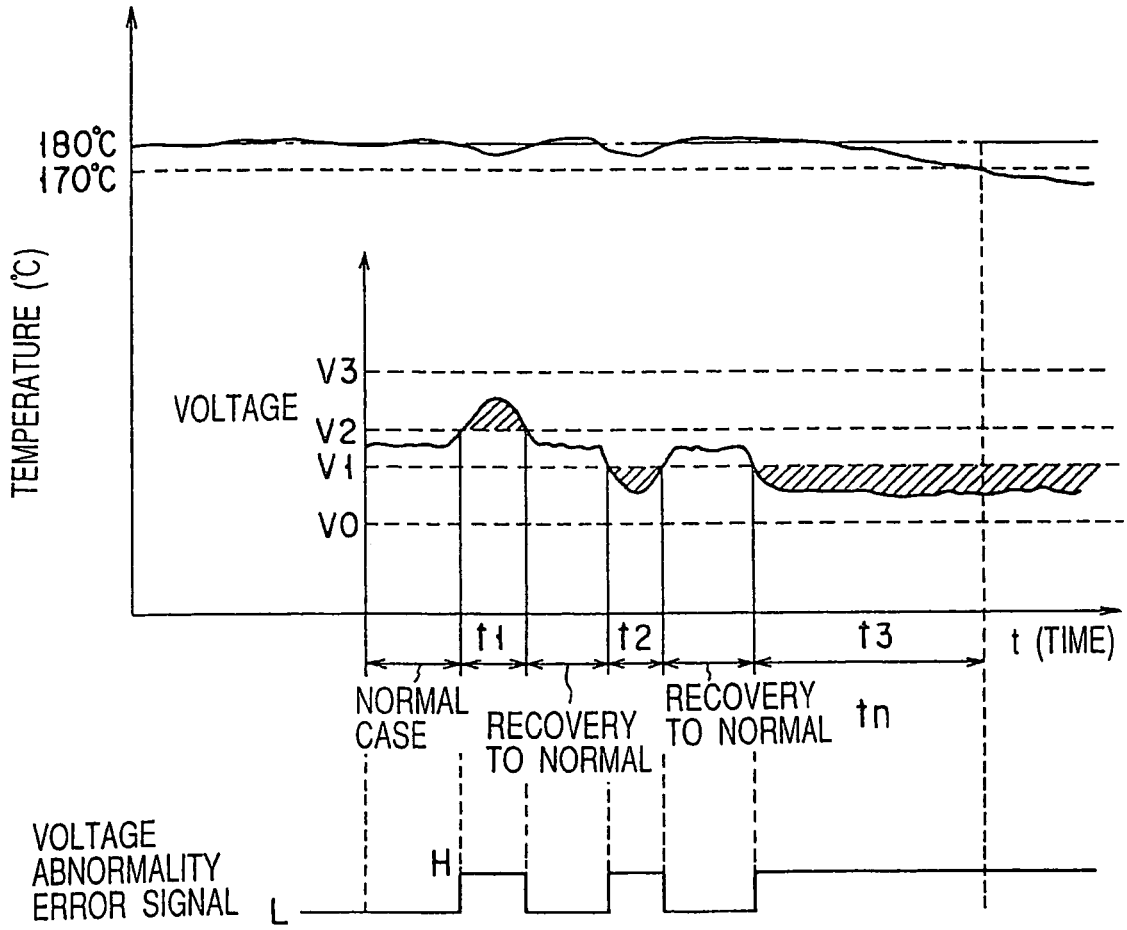
FIG. 8 is a schematic view which explains the voltage applied to the magnetic excitation coil of the fixing device shown in FIG. 2 and voltage abnormality.

Meanwhile, in case where the power source voltage changes as shown in FIG. 8, in the photocopier 101 achieves normal operation if the voltage change falls between the V3 to the V0. On the other hand, the range of a voltage change which the magnetic excitation coil 11 can permit is the V2 smaller than the V3 to V1 greater than the V0. As shown in FIG. 8, if a voltage drop of a length $t_n$ continues due to some reason, thee surface temperature goes below a set value.

In this case, the drive circuit shown in FIG. 4, detects voltage abnormalities at timed intervals is counted under control of the CPU 39, and shuts off power to the magnetic excitation coil 11.

More specifically, the main control CPU 39 regards it as being normal that a voltage abnormality error signal outputted from the IH control circuit 38 is L. If the voltage abnormality error signal changes to H, the CPU 39 resets the timer and measures the time for which the voltage abnormality error signal is at H.

For example, as shown in FIG. 7, if the voltage V2 as a voltage increase continues for a length $t_1$, the main control CPU 39 compares it to a predetermined error timer value (limit value) $t_n$ of the voltage abnormality error signal. Since $t1<t_n$ exists, this abnormality is neglected as being a voltage abnormality which merely temporarily causes the voltage V2. The error timer value $t_n$ is a time which influences the fixing temperature and is expressed in units of several seconds. For example, if the copying performance is 60 ppm (cpm), $t_n$ is 1 second. If the copying performance is 30 ppm (cpm), $t_n$ is two seconds.

Meanwhile, in FIG. 7, if the voltage V1 as a voltage drop continues for a length t2, $t2<t_n$ is satisfied by the duration time t2 of the voltage abnormality error signal with respect to the error timer value $t_n$. In this case, similarly, the abnormality is neglected as a voltage abnormality which merely temporarily causes the voltage V1. That is, it is not regarded as an abnormality because a normal state is recovered in a time t2 ($<t_n$).

As has been explained above, if the voltage V1 as a voltage drop continues for $t_n$ or more, the time $t_n$ for which V1 continues exceeds the error timer value $t_n$. It is hence determined that a voltage abnormality has occurred, and electric power to the magnetic excitation coil 11 is shut off.

Meanwhile, with respect to the influence of voltage changes which have been explained with reference to FIG. 8, the probability of such variations occurring depend on the local power supply.

Therefore, a voltage abnormality error can be prevented by setting the error timer value $t_n$ to an appropriate size (length). In areas where the error timer values tn must be set individually, the maximum input power can be prevented from exceeding a preset value, by appropriately changing the relationship between the operation mode and the electric power of the coil (e.g., the table stored in the memory). In addition, the fixing device can be driven more stably by appropriately changing the duty ratio of the high-frequency current, from the relationship with the maximum usable electric power.

The method for restricting the level of the electric power is a method in which the duty ratio is reduced, to restrict the total amount of input current and for reducing the duty ratio with respect to only a predetermined time in order to reduce the electric power caused by a surge current.

Also, in districts where a plurality of power source voltages can be used, it is possible to prevent an abnormal voltage from being undesirably generated, by appropriately changing the relationship between the operation mode and the electric power which can be supplied to the coil shown in FIG. 6.

In the case where cardboard or the like which permits a strict fixing condition is used regardless of a voltage change, the fixing rate may change in accordance with the elapse of time (repetition of image formation). In this case, a constant fixing rate can be secured with respect to a paper sheet having an arbitrary thickness, by storing the relationship between the thickness of the paper sheet and the current to be supplied to the coil, into a memory table, as in the case explained with reference to FIG. 6. Although the thickness of the paper sheet does not require special treatment if surface temperature has reached a desired target temperature, it can contribute to a low temperature or the like. Therefore, a memory table for a low temperature may be prepared.

As has been explained above, the present invention provides a fixing device for use in an image forming apparatus in which a high-frequency current is flowed through a coil provided close to an endless member having a metal layer made of a conductive material and this endless member is caused to generate heat to heat a material to be fixed, characterized in that the fixing device is controlled in accordance with a plurality of electric power control patterns corresponding to electric power supplies or predetermined conditions, respectively. The warm-up time can be shortened so that the heat roller can be heated efficiently.

It is hence possible to supply an optimal high-frequency current, selected among a plurality of frequencies in correspondence with the operation mode, so that the heat roller can be heated, in a short time, to a temperature at which fixing is enabled.

Also, the time required for the first copy can be shortened by incorporating the fixing device into the digital photocopier.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device for use in an image forming apparatus which generates heat to heat a material to be fixed, comprising:

a heat roller which is rotatable about a central axis and has a metal layer formed of a conductive material;

a press roller which is rotated by being brought into contact with the heat roller, wherein a nip portion is formed between the press roller and the heat roller, and the material to be fixed is sandwiched in the nip portion;

a magnetic excitation coil which is formed of a litz wire and is provided inside the heat roller;

a drive circuit which supplies a high-frequency current in the magnetic excitation coil; and a control device which controls the drive circuit in accordance with electric power amounts supplied for respective predetermined conditions.

2. The fixing device according to claim 1, wherein the diameter of the litz wire is smaller than a penetration depth.

3. The fixing device according to claim 1, wherein the litz wire is coated with polyamide-imide to be heat-resistant.

4. The fixing device according to claim 1, wherein the magnetic excitation coil is supported inside the heat roller by a coil support member formed of heat-resistant resins.

5. The fixing device according to claim 1, wherein the drive circuit rectifies an alternating current from a commercial power source by means of a rectifier circuit and a smoothing capacitor, and supplies a high-frequency current to the magnetic excitation coil by an inverter circuit formed of a coil resonant condenser and a switching circuit.

6. The fixing device according to claim 5, further comprising:

an input detection unit which detects the high-frequency current supplied to the magnetic excitation coil, wherein the high-frequency current is controlled to maintain a specified output value by changing the ON time of a switching element at an arbitrary timing under PWM control in accordance with detection results obtained by the input detection unit.

7. The fixing device according to claim 1, wherein the magnetic excitation coil is an air-core coil, and magnetic flux is generated in different intensities in directions toward the circumference while the heating roller stops rotating.

8. The fixing device according to claim 7, wherein rotation of the heat roller is stopped for a constant time period immediately after the magnetic excitation coil is energized, and after a predetermined time, the heat roller and the press roller are rotated to make uniform the temperature distribution of the entire heat roller.

9. The fixing device according to claim 1, wherein the drive circuit detects a voltage abnormality that a fluctuation of the voltage has exceeded an acceptable range of the magnetic excitation circuit, and when the voltage abnormality does not last for a predetermined time, the voltage abnormality is neglected, and when the voltage abnormality continues longer than the predetermined time, electricity is stopped from being supplied to the magnetic excitation coil.

10. A fixing device for use in an image forming apparatus comprising:

a heat roller which is rotatable about a central axis and has a metal layer formed of a conductive material;

a press roller which is rotatable and brought into contact with the heat roller, wherein a nip portion is formed between the press roller and the heat roller, and the material to be fixed is sandwiched in the nip portion;

a magnetic excitation coil which is formed of a litz wire and is provided close to the heat roller;

a drive circuit which supplies a high-frequency current in the magnetic excitation coil; and a control device which controls the drive circuit in accordance with the electric power amounts supplied for respective predetermined conditions.

11. An image forming apparatus including a fixing device which generates heat to heat a material to be fixed, said fixing device comprising:

a heat roller which is rotatable and has a metal layer formed of a conductive material;

a press roller which is rotatable and brought into contact with the heat roller, wherein a nip portion is formed between the press roller and the heat roller, and the material to be fixed is sandwiched in the nip portion;

a magnetic excitation coil which is formed of a litz wire and is provided close to the heat roller;

a drive circuit which supplies a high-frequency current in the magnetic excitation coil; and a control device which controls the drive circuit in accordance with electric power amounts supplied for respective predetermined conditions.

* * * * *